US009411270B1

(12) United States Patent
Furuki et al.

(10) Patent No.: US 9,411,270 B1
(45) Date of Patent: Aug. 9, 2016

(54) CLEANING DEVICE AND IMAGE FORMING APPARATUS

(71) Applicant: FUJI XEROX CO., LTD., Tokyo (JP)

(72) Inventors: Manabu Furuki, Kanagawa (JP); Masahiro Uchida, Kanagawa (JP); Masashi Ikeda, Kanagawa (JP); Tatsuhiro Igarashi, Kanagawa (JP); Mona Tasaki, Kanagawa (JP); Teppei Yawada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/850,454

(22) Filed: Sep. 10, 2015

(30) Foreign Application Priority Data

Jan. 26, 2015 (JP) ..... 2015-012005

(51) Int. Cl.
*G03G 21/00* (2006.01)
*G03G 15/16* (2006.01)

(52) U.S. Cl.
CPC ..... *G03G 15/161* (2013.01); *G03G 21/0011* (2013.01)

(58) Field of Classification Search
CPC ..... G03G 21/0011; G03G 15/161
USPC ..... 399/349, 350
See application file for complete search history.

(56) References Cited

U.S. PATENT DOCUMENTS 7,711,307 B2 * 5/2010 Kageyama ..... 399/350

FOREIGN PATENT DOCUMENTS

| | | | |
|---|---|---|---|
| JP | 2011-141377 | A | 7/2011 |
| JP | 2011-215549 | A | 10/2011 |
| JP | 2012-013984 | A | 1/2012 |

* cited by examiner

*Primary Examiner* — Hoang Ngo
(74) *Attorney, Agent, or Firm* — Oliff PLC

(57) ABSTRACT

A cleaning device includes a removal member that forms piled bodies of residual objects at a contact location and removes residual objects from a surface of a target cleaning member by contacting with the surface in a linear manner and rubbing against the surface, and a smoothing member that smooths out the piled bodies by moving along the contact location.

15 Claims, 4 Drawing Sheets

CLEANING DEVICE AND IMAGE FORMING APPARATUS

CROSS-REFERENCE TO RELATED APPLICATIONS

This application is based on and claims priority under 35 USC 119 from Japanese Patent Application No. 2015-012005 filed Jan. 26, 2015.

BACKGROUND (i) Technical Field

The present invention relates to a cleaning device and an image forming apparatus.

(ii) Related Art

In the related art, image forming apparatuses that form images using toner, and cleaners that clean residual toner using a cleaning blade, are known.

SUMMARY

According to an aspect of the invention, there is provided a cleaning device including:

a removal member that forms piled bodies of residual objects at a contact location and removes residual objects from a surface of a target cleaning member by contacting with the surface in a linear manner and rubbing against the surface; and a smoothing member that smooths out the piled bodies by moving along the contact location.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the drawings.

Figure 1:
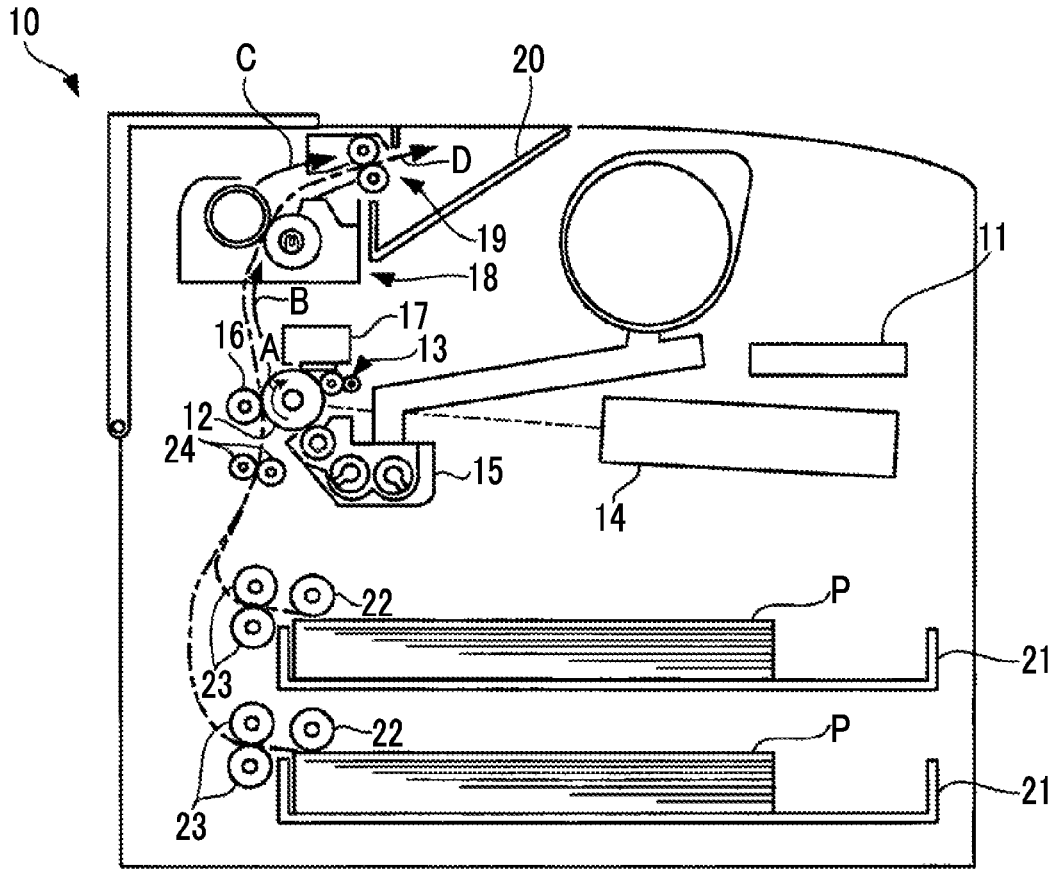
FIG. 1 shows a schematic configuration of a printer of an image forming apparatus according to an exemplary embodiment.

FIG. 1 shows a schematic configuration of a printer of an image forming apparatus according to the exemplary embodiment.

A printer 10 that is shown in FIG. 1 is a monochrome printer, and an image signal created outside the printer 10, which represents images, is input to the printer 10 via a signal cable or the like, which is not shown. A control unit 11, which controls the movements of each constituent element inside the printer 10, is provided in the printer 10, and the image signal is input to the control unit 11. Further, in the printer 10, the formation of images based on the image signal is performed under the control of the control unit 11.

A paper sheet tray 21 is provided in a lower section of the printer 10, and sheets of paper P are accommodated in the paper sheet tray 21 in a piled up state. The paper sheet tray 21 is configured so as to be capable of being freely withdrawn in order to replenish the sheets of paper P.

The sheets of paper P inside the paper sheet tray 21 are delivered to a registration roller 24 by a pickup roller 22 and a handling roller 23. A transport timing of the sheets of paper P that arrive at the registration roller 24 is adjusted and the sheets of paper P are further transported.

A cylindrical photosensitive member 12, which rotates with an orientation shown by an arrow A, is provided in the printer 10 above the registration roller 24. Further, a charging device 13, an exposure device 14, a developing device 15, a transfer device 16, and a photosensitive member cleaner 17 are arranged in the vicinity of the photosensitive member 12. The photosensitive member 12 corresponds to an example of an image holding member that is referred to in the present invention, a component in which the exposure device 14 and the developing device 15 are combined corresponds to an example of a formation device that is referred to in the present invention, and the transfer device 16 corresponds to an example of a transfer device that is referred to in the present invention.

The charging device 13 charges the surface of the photosensitive member 12, and the exposure device 14 forms an electrostatic latent image by exposing the surface of the photosensitive member 12 in accordance with the image signal that is delivered from the control unit 11. A toner image is formed as a result of the electrostatic latent image being developed by the developing device 15. In this instance, the charging device 13 may be a contact type charging device that is provided with a charging roller or the like, or may be a non-contact type charging device that is provided with an electrical discharge wire or the like. The exposure device 14 may be an exposure device in which laser light is set as a light source, or may be an exposure device in which an LED or the like is set as the light source. In addition, the developing device 15 may be a developing device that uses a so-called two component developing agent in which a toner and a carrier are mixed, or may be a developing device that uses a developing agent in which a toner is the main component.

In this instance, the above-mentioned registration roller 24 feeds out the sheets of paper P so that the sheets of paper P reach a position that faces the transfer device 16 matching a timing with which toner images on the photosensitive member 12 reach the position. Further, the toner images on the photosensitive member 12 are transferred onto the sheets of paper P that are fed out by the transfer device 16.

Toner (residual toner) that remains on the photosensitive member 12 after the transfer of toner images is removed from the photosensitive member 12 by the photosensitive member cleaner 17. A rubber cleaning blade 170 is provided in the photosensitive member cleaner 17, and the cleaning blade 170 has a long plate shape that extends along a direction which the cylindrical photosensitive member 12 extends. Further, the cleaning blade 170 contacts with the photosensitive member 12 in a linear manner at a side thereof that extends along the photosensitive member 12. For convenience, there are cases in which the side that contacts with the photosensitive member 12 will be referred to as the edge of the cleaning blade 170. Since the photosensitive member 12 rotates in contrast to the cleaning blade 170 being fixed, the cleaning blade 170 rubs against the surface of the photosensitive member 12 at the edge, and scrapes away and removes residual objects (such as residual toner, an external additive that is mixed in the toner, and paper dust that is derived from the sheets of paper P) from the surface of the photosensitive member 12 as a result of this action. This kind of photosensitive member cleaner 17 corresponds to a cleaning device according to the exemplary embodiment, and the cleaning blade 170 corresponds to an example of a removal member that is referred to in the present invention.

The sheets of paper P that receive the transfer of toner images progress further in the direction of an arrow B, and the toner images are fixed onto the sheets of paper P as a result of receiving heating and pressurization due to a fixing unit 18. As a result of this, images that are formed from fixed toner images are formed on the sheets of paper P.

The sheets of paper P that pass through the fixing unit 18 progress in a direction of an arrow C toward a discharge unit 19, are further delivered in a direction of an arrow D by the discharge unit 19, and are discharged to a paper discharge holder 20.

Given that, when residual objects are scraped away from the photosensitive member 12 surface by the cleaning blade 170, a portion of the scraped away residual objects remains along the edge of the cleaning blade 170, and piled bodies called toner dams and external additive dams are formed. Residual objects are reliably scraped away as a result of the presence of the piled bodies, and the maintenance of the piled bodies is required in the maintenance of the cleaning ability of the cleaning blade 170.

However, for example, there is a concern that, a localized load will be applied to the cleaning blade 170 at locations with few piled bodies, and that the cleaning blade 170 will become damaged due to friction with the photosensitive member 12, and therefore, that the cleaning ability thereof will be reduced when deviations occur in residual objects on the photosensitive member 12, and piled bodies are unevenly distributed along the edge in cases in which one kind of image is formed continuously, or the like. Further, there are cases in which striped image defects occur when the cleaning ability falls in this manner.

In such an instance, a procedure for alleviating uneven distribution of the piled bodies is carried out on the photosensitive member cleaner 17 of the printer 10 that is shown in FIG. 1.

Figure 2:
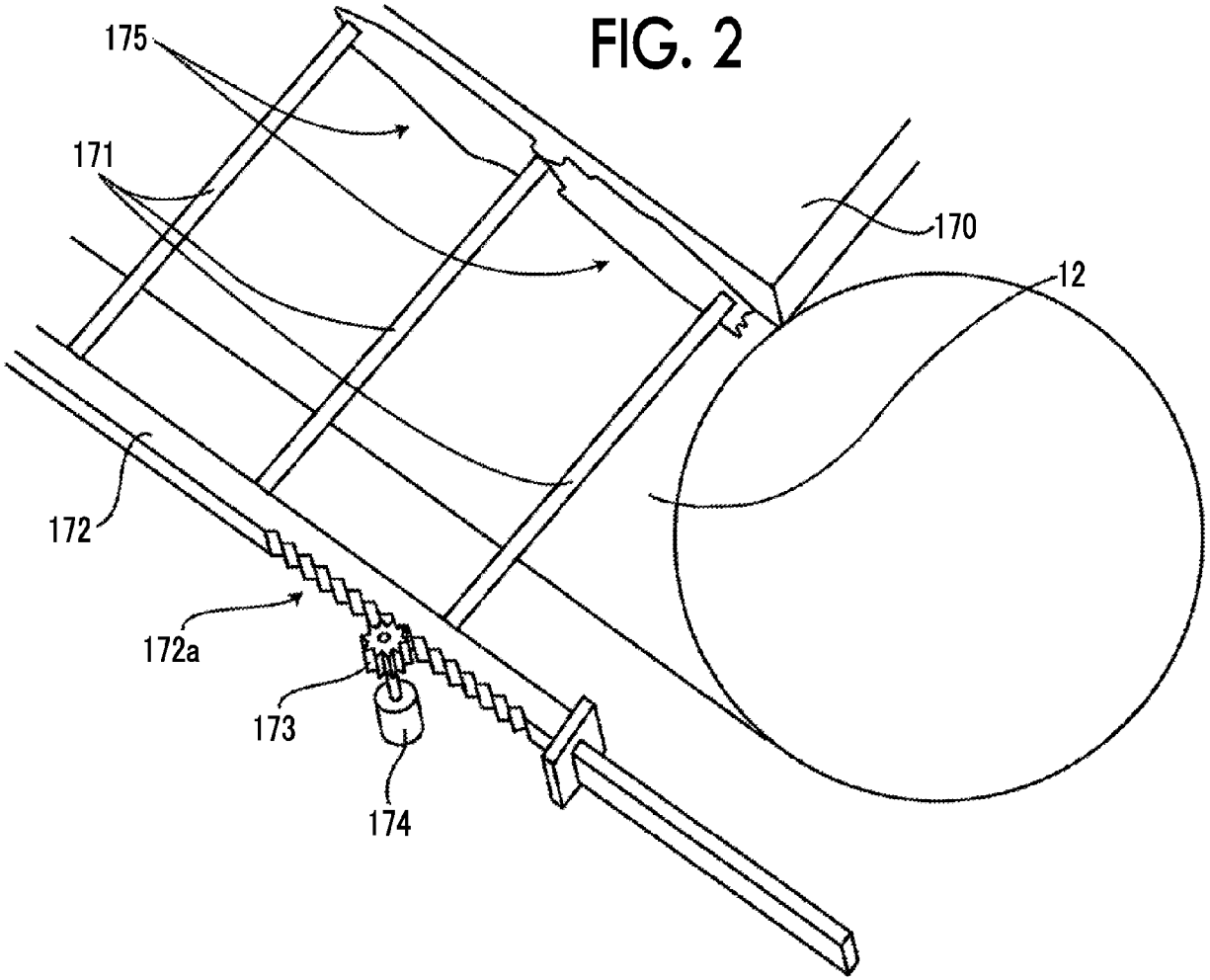
FIG. 2 is a perspective view that schematically shows a cleaning blade periphery inside a photosensitive member cleaner.
Figure 3:
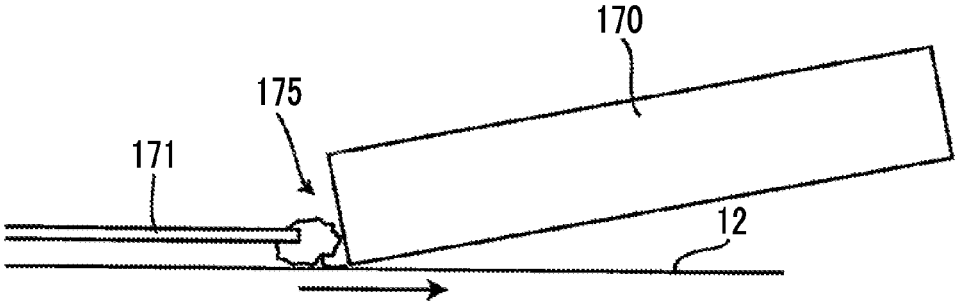
FIG. 3 is a side view that schematically shows a cleaning blade periphery inside the photosensitive member cleaner.

FIGS. 2 and 3 schematically show a cleaning blade periphery inside a photosensitive member cleaner, FIG. 2 is a perspective view, and FIG. 3 is a side view.

Multiple moving rods 171, which extend so as to protrude toward the edge of the cleaning blade 170 are arranged inside the photosensitive member cleaner 17 along the edge. The moving rods 171 protrude from a downstream side toward an upstream of surface movement of the photosensitive member 12.

As shown above, the edge of the cleaning blade 170 scrapes away residual objects from the photosensitive member 12 surface, and as a result, piled bodies 175 are formed along the edge of the cleaning blade 170. Further, the tip end of each moving rod 171 protrudes to a position that reaches the piled bodies 175 but does not contact with the cleaning blade 170. The moving rods 171 correspond to an example of a smoothing member that is referred to in the present invention.

The multiple moving rods 171 are supported by a support member 172 in a state of protruding from the support member 172. Further, the support member 172 is held so as to be freely moveable in a direction that runs along the edge, and a gear 172*a* is formed on a side surface of the support member 172. In addition, a so-called rack and pinion structure is formed by a pinion gear 173 engaging with the gear 172*a* of the support member 172, and the pinion gear 173 rotates due to a motor 174, which is controlled by the control unit 11 that is shown in FIG. 1. Each moving rod 171 moves along the edge of the cleaning blade 170 as a result of the pinion gear 173 rotating, and as a result, the piled bodies 175 are smoothed by the tip end of each moving rod 171. Deviations in the piled bodies 175 are suppressed as a result of the piled bodies 175 being smoothed out, and a localized load on the cleaning blade 170 is reduced. Consequently, the cleaning ability of the cleaning blade 170 is maintained.

For example, the movement of the moving rods 171 is executed during pauses in image formation or the like. In addition, since multiple moving rods 171 are arranged along the edge, the piled bodies 175 are smoothed out across the entire length of the edge of the cleaning blade 170 as a result of each moving rod 171 moving a distance of an extent of a mutual interval, and the smoothing is completed in a short time.

Next, another example of a smoothing member that is referred to in the present invention will be described.

Figure 4:
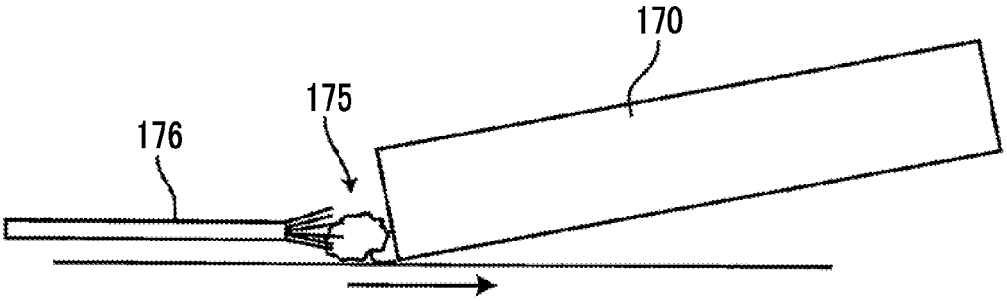
FIG. 4 shows another example of a smoothing member.

FIG. 4 shows another example of a smoothing member.

In this instance, an example in which a moving brush 176 is provided as a smoothing member, is shown. A tip end of the moving brush 176 is branched into multiple parts, and the piled bodies 175 are effectively smoothed out by the moving brush 176 that has this kind of branched tip end.

Next, the contribution of the smoothing member will be described based on an example.

Figure 5:
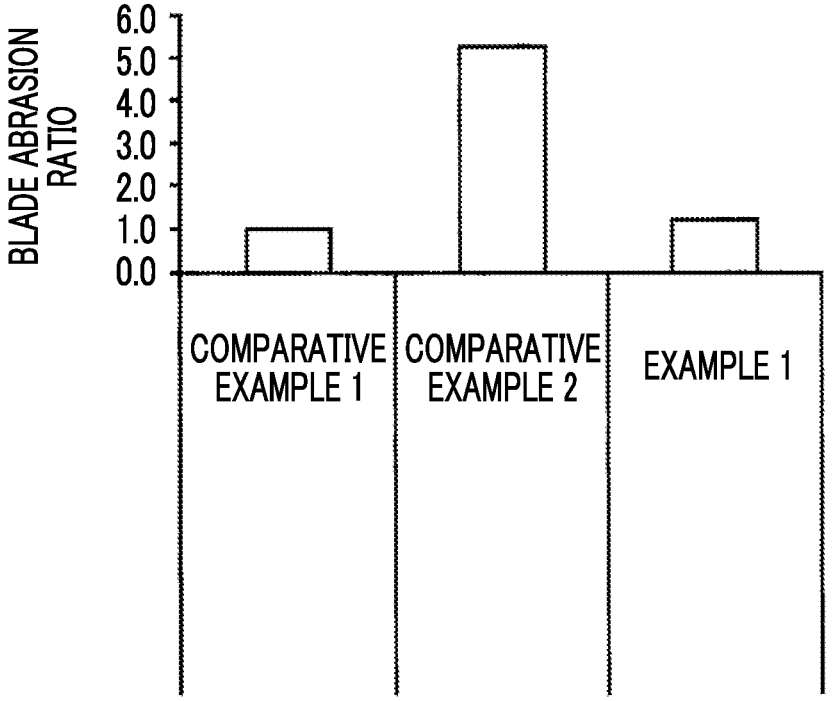
FIG. 5 is a graph that represents results in which the abrasion of the cleaning blade is compared in an example and comparative examples.

FIG. 5 is a graph that represents results in which the abrasion of the cleaning blade is compared in an example and comparative examples.

In FIG. 5, respective abrasion amounts of the cleaning blade in a comparative example 1, in which toner with an average particle diameter of 7.0 μm is used and the smoothing member is not arranged, a comparative example 2, in which toner with an average particle diameter of 4.0 μm is used and the smoothing member is not arranged, and an example 1, in which toner with an average particle diameter of 4.0 μm is used and the same smoothing member as the example that is shown in FIGS. 2 and 3 is arranged, are shown in a bar graph that represents a relative ratio in which the case of the comparative example 1 is set as 1.0. In the comparative example 2, the abrasion amount of the cleaning blade is increased by approximately five times in comparison with the comparative example 1. This increase in the abrasion amount is remarkable in small diameter toner in which the average particle diameter is 4.5 μm or less. Conversely, in cases in which the average particle diameter of the toner is larger than 7.0 μm, there is not a much difference from the abrasion amount of the example 1.

By the graph shown in FIG. 5, the fact that the abrasion amount in the example 1 is suppressed to an abrasion amount that does not differ much from the comparative example 1, is confirmed. In other words, in small diameter toner with an average particle diameter of 4.5 μm or less in which increases in the abrasion amount of the cleaning blade occur, the fact that the suppression of the abrasion amount as a result of providing the smoothing member is remarkable, is confirmed. Specifically, the increase in the abrasion amount is remarkable in a case of a volume average particle diameter of 4.8 μm or less.

Additionally, in the description of the above-mentioned exemplary embodiment, an example in which the smoothing member that is referred to in the present invention is moved using a rack and pinion method is shown, but the smoothing member that is referred to in the present invention may be moved using a belt driving method.

In addition, in the above-mentioned exemplary embodiment, a monochrome printer is shown byway of example, but the present invention may also be applied to a color device, and may also be applied to a facsimile, a copy machine, or a multifunction machine.

In addition, in the above-mentioned exemplary embodiment, a device that forms toner images using an electrophotography method is shown by way of example, but the formation device that is referred to in the present invention may be a device that directly draws toner images onto an image holding member using an electrode array or the like.

In addition, in the above-mentioned exemplary embodiment, a transfer device that directly transfers toner images from a photosensitive member to the sheets of paper is shown by way of example, but the transfer device that is referred to in the present invention may also be a device that indirectly transfers from an image holding member to a recording medium via an intermediate transfer member or the like.

In addition, in the above-mentioned exemplary embodiment, the sheets of paper are shown as a recording medium by way of example, but the recording medium that is referred to in the present invention may be OHP sheets, or may be plastic paper or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a removal member that forms piled bodies of residual objects at a contact location and removes residual objects from a surface of a target member by contacting with the target member surface in a linear manner and rubbing against the target member surface; and a smoothing member that smooths out the piled bodies by moving along the contact location, wherein the piled bodies are located at portions along an edge of the removal member at the contact location, and wherein the smoothie member is positioned so as to contact the piled bodies but does not contact the removal member or the target member surface.

2. The cleaning device according to claim 1, wherein the residual objects include particles for forming an image on the surface of the target member with a volume average particle diameter of 4.8 μm or less.

3. The cleaning device according to claim 1, wherein a plurality of the smoothing members are included along the contact location.

4. The cleaning device according to claim 1, wherein the removal member is a cleaning blade.

5. The cleaning device according to claim 1, wherein the smoothing member is a brush.

6. The cleaning device according to claim 1, wherein the smoothing member smooths out the piled bodies by moving in a direction extending along a direction in which the target member extends.

7. The cleaning device according to claim 1, wherein the smoothing member comprises a plurality of moving rods or a moving brush with a branched tip end.

8. An image forming apparatus comprising:

an image holding member that holds images that are formed on a surface;

an image formation unit that forms the images;

a transfer device that transfers the images onto a recording medium from the image holding member;

a removal member that forms piled bodies of residual objects at a contact location and removes residual objects from a surface of the image holding member by contacting with the image holding member surface in a linear manner and rubbing against the image holding member surface; and a smoothing member that smooths out the piled bodies by moving along the contact location, wherein the piled bodies are located at portions along an edge of the removal member at the contact location, and wherein the smoothing member is positioned so as to contact the piled bodies but does not contact the removal member or the image holding member surface.

9. The image forming apparatus according to claim 8, wherein the image holding member is an image holding member on which toner images are formed.

10. The image forming apparatus according to claim 8, wherein the residual objects include particles for forming an image on a surface of the image holding member with a volume average particle diameter of 4.8 μm or less.

11. The image forming apparatus according to claim 8, wherein a plurality of smoothing members are included along the contact location.

12. The image forming apparatus according to claim 8, wherein the removal member is a cleaning blade.

13. The image forming apparatus according to claim 8, wherein the smoothing member is a brush.

14. The image forming apparatus according to claim 8, wherein the smoothing member smooths out the piled bodies by moving in a direction extending along a direction in which the image holding member extends.

15. The image forming apparatus according to claim 8, wherein the smoothing member comprises a plurality of moving rods or a moving brush with a branched tip end.

* * * * *